US010617936B2

(12) United States Patent
Koch et al.

(10) Patent No.: US 10,617,936 B2
(45) Date of Patent: Apr. 14, 2020

(54) PERSONAL TRANSPORT APPARATUS

(71) Applicant: SKATE INNOVATION PTY LTD., Bibra Lake, WA (AU)

(72) Inventors: Jason Koch, Maudsland (AU); Daniel James DeGaye, Beeliar WA (AU)

(73) Assignee: Skate Innovations Pty Ltd., Bibra Lake, WA (AU)

( * ) Notice: Subject to any disclaimer, the term of this patent is extended or adjusted under 35 U.S.C. 154(b) by 0 days.

(21) Appl. No.: 16/099,307

(22) PCT Filed: May 10, 2017

(86) PCT No.: PCT/AU2017/050427
§ 371 (c)(1),
(2) Date: Nov. 6, 2018

(87) PCT Pub. No.: WO2017/193166
PCT Pub. Date: Nov. 16, 2017

(65) Prior Publication Data

US 2019/0209913 A1 Jul. 11, 2019

(30) Foreign Application Priority Data

May 10, 2016 (AU) ..... 2016901746
Aug. 29, 2016 (AU) ..... 2016903430

(51) Int. Cl.
*A63C 17/26* (2006.01)
*A63C 17/01* (2006.01)

(52) U.S. Cl.
CPC ..... *A63C 17/265* (2013.01); *A63C 17/012* (2013.01); *A63C 17/26* (2013.01); *A63C 17/01* (2013.01)

(58) Field of Classification Search
CPC ..... A63C 17/265; A63C 17/012; A63C 17/26; A63C 17/01
See application file for complete search history.

(56) References Cited

U.S. PATENT DOCUMENTS 1,075,250 A * 10/1913 Gingold ..... B62K 3/002 280/87.041
1,416,864 A * 5/1922 Parkes ..... B62K 3/002 280/7.1

(Continued)

FOREIGN PATENT DOCUMENTS

CN 105539669 5/2016

OTHER PUBLICATIONS

ScootTow website Dec. 21, 2013 [online], [retrieved from Internet on Nov. 6, 2018] URL:http://web.archive.org/web/20131221232357/http://scootow.com/.

(Continued)

*Primary Examiner* — Erez Gurari
(74) *Attorney, Agent, or Firm* — Caesar Rivise, PC

(57) ABSTRACT

A personal transport includes a deck configured for supporting a rider in a standing position. At least one wheel assembly is mounted on a bottom surface of the deck, the, or each, wheel assembly having at least one wheel so that the deck can travel over a substrate. An operator handle is substantially rigidly mounted on a rear end of the deck and extends rearwardly from the deck so that an operator, standing on the substrate, can grasp the operator handle and push the apparatus along the substrate, or tilt the apparatus relative to the substrate, while the rider is supported on the deck. A rider handle mounted on one of the deck and the operator handle and positioned so that the rider can grasp the rider handle for balance while supported by the deck.

17 Claims, 12 Drawing Sheets

(56) References Cited

U.S. PATENT DOCUMENTS

D250,610 S * 12/1978 Wynn ..... D21/423
4,134,599 A * 1/1979 DiMille ..... A63C 17/01 188/29
4,149,735 A 4/1979 Blackburn et al.
4,179,134 A 12/1979 Atkinson
4,183,546 A * 1/1980 Heilig ..... A63C 17/01 280/11.212
4,951,958 A * 8/1990 Chao ..... A63C 17/26 188/16
5,029,661 A * 7/1991 Wallace ..... A63C 17/01 180/165
5,090,716 A * 2/1992 Borden ..... A63C 17/004 280/87.042
5,154,436 A * 10/1992 Jez ..... A63C 17/012 280/11.28
5,487,441 A * 1/1996 Endo ..... A63C 17/004 180/181
6,199,880 B1 * 3/2001 Favorito ..... A63C 17/01 280/14.28
6,206,388 B1 * 3/2001 Ouboter ..... A63C 17/01 280/87.042
6,341,790 B1 * 1/2002 Chen ..... A63C 17/01 280/267
D456,047 S * 4/2002 Mandic ..... D21/423
6,367,828 B1 * 4/2002 Mandic ..... B60T 1/14 280/87.05
6,382,646 B1 * 5/2002 Shaw ..... B62K 3/002 280/11.28
6,431,302 B2 * 8/2002 Patmont ..... B62K 3/002 180/181
6,520,517 B1 * 2/2003 Chung ..... B62K 3/002 280/124.11
6,991,243 B2 1/2006 Boyle et al.
7,487,987 B2 * 2/2009 Yan ..... B62K 3/002 280/221
7,513,513 B2 * 4/2009 Hong ..... B62K 3/002 280/47.315
D635,212 S * 3/2011 Woncik ..... D21/765
8,613,457 B2 * 12/2013 Wegener ..... B62K 3/002 280/87.01
D736,861 S * 8/2015 Eckert ..... D21/423
10,167,034 B2 * 1/2019 Lemaitre ..... B62K 3/002
10,398,961 B2 * 9/2019 McGowan ..... A63C 17/265
2001/0028155 A1 * 10/2001 Way, II ..... A63C 17/28 280/87.01
2002/0121757 A1 * 9/2002 Louh ..... B62K 3/002 280/87.041
2002/0167142 A1 * 11/2002 Chen ..... A63C 17/01 280/87.041
2003/0011159 A1 * 1/2003 Tsai ..... A63C 17/01 280/87.041
2007/0235970 A1 * 10/2007 Stillinger ..... A63C 17/012 280/87.041
2009/0079149 A1 * 3/2009 Taylor ..... A63C 1/36 280/14.26
2009/0156094 A1 6/2009 Seckel et al.
2011/0037244 A1 * 2/2011 Lopez ..... A63C 17/267 280/810
2011/0121551 A1 * 5/2011 Hadley ..... B62K 3/002 280/762
2014/0210175 A1 * 7/2014 Hsu ..... A63C 17/012 280/87.042
2017/0120138 A1 * 5/2017 Kang ..... A63C 17/0006
2018/0185739 A1 * 7/2018 McGowan ..... A63C 17/011
2018/0207656 A1 * 7/2018 Wang ..... B05B 9/007
2018/0229103 A1 * 8/2018 Clos ..... A63C 17/012
2018/0361226 A1 * 12/2018 Cho ..... A63C 17/0033
2019/0209913 A1 * 7/2019 Koch ..... A63C 17/012

OTHER PUBLICATIONS

International Search Report for PCT/AU 2017/050427 dated Jun. 5, 2017.

Supplementary European Search Report for corresponding European Patent Application No. EP17795187 dated Nov. 15, 2019.

* cited by examiner

PERSONAL TRANSPORT APPARATUS

CROSS REFERENCE TO RELATED APPLICATIONS

This United States national phase application claims benefit under 35 U.S.C. § 371 of PCT Application No. PCT/AU2017/050427 filed on May 10, 2017, which in turn claims benefit under Australian Application Serial No. 2016901746 filed on May 10, 2016 and Australian Application Serial No. 2016903430 filed on Aug. 29, 2016 and all of whose entire disclosures are incorporated by reference herein.

FIELD OF THE INVENTION

Various exemplary embodiments of a personal transport apparatus are described herein.

SUMMARY OF THE INVENTION

According to one aspect, there is provided a personal transport apparatus which comprises:

a deck configured for supporting a rider in a standing position;

at least one wheel assembly mounted on a bottom surface of the deck, the, or each, wheel assembly having at least one wheel so that the deck can travel over a substrate;

an operator handle substantially rigidly mounted on a rear end of the deck and extending rearwardly from the deck so that an operator, standing on the substrate, can grasp the operator handle and push the apparatus along the substrate, or tilt the apparatus relative to the substrate, while the rider is supported on the deck; and a rider handle mounted on one of the deck and the operator handle and positioned so that the rider can grasp the rider handle for balance while supported by the deck.

The deck may be elongate and the at least one wheel assembly may be in the form of a rear wheel assembly positioned towards a rear end of the deck and a front wheel assembly positioned towards a front end of the deck.

Each wheel assembly may include a pair of the wheels.

Each wheel assembly may include a truck that is fastened to a bottom surface of the deck with each pair of wheels being mounted on respective trucks.

The operator handle may include an elongate support that is mountable to the deck at one end of the deck. The elongate support may be demountable.

The deck may include a socket member that defines a socket, one end of the support being receivable in the socket.

The deck may include a deck body, a chassis mounted in the body to extend from a rear end portion of the body to a position beyond the rear wheel assembly and a deck cover arranged on the body.

The chassis may include a bracket at its rear end, a mounting member for the operator handle being fastened to the bracket so that the mounting member extends upwardly and rearwardly from the chassis, the mounting member also extending through the deck cover.

The mounting member may be in the form of a mounting tube that defines a socket, the operator handle including an elongate support, one end of which is received in the socket.

The chassis may include at least one reinforcing member that extends at least partly along a length of the body.

The, or each, reinforcing member is in the form of two elongate tilt members that are operatively engaged with the bracket and fastened to the deck body, the tilt members being spaced apart and extending from the bracket to at least a position interposed between the rear and front wheel assemblies so that torque applied to the bracket can be transferred to the tilt members and thus the deck body.

The tilt members may be fastened to the deck body with at least one bracing member.

The rider handle may be mounted on the elongate support and may extend forwardly from the elongate support.

The operator handle may include a handle bar mounted on an upper end of the elongate support so that the operator can grasp the handle bar while pushing or pulling the transport apparatus.

The rider handle may extend from the deck, at or near a front end of the deck. The rider handle may include an elongate support that is fixed to the deck and a handle bar mounted on an upper end of the elongate support.

A ground-engaging formation may be arranged on the bottom surface of the deck and may be interposed between the rear wheel assembly and the rear end of the deck. The ground-engaging formation may be in the form of one of an ellipsoidal projection and a spheroidal projection. The ground-engaging formation may be in the form of a ball that is rotatable relative to the deck. The ball may have full rotational freedom relative to the deck.

According to another aspect, there is provides a personal transport apparatus which comprises:

a deck configured for supporting a rider in a standing position;

at least one wheel assembly mounted on a bottom surface of the deck, the, or each, wheel assembly having at least one wheel so that the deck can travel over a substrate;

an operator handle mounting assembly arranged at a rear end of the deck and configured to permit an operator handle to be substantially rigidly mounted on the rear end of the deck and extending rearwardly from the deck so that an operator, standing on the substrate, can grasp the operator handle and push the apparatus along the substrate, or tilt the apparatus relative to the substrate, while the rider is supported on the deck; and a rider handle mounting assembly arranged on one of the deck and the operator handle to permit a rider handle to be mounted on one of the deck and the operator handle and positioned so that the rider can grasp the rider handle for balance while supported by the deck.

DESCRIPTION OF EMBODIMENTS

Figure 2:
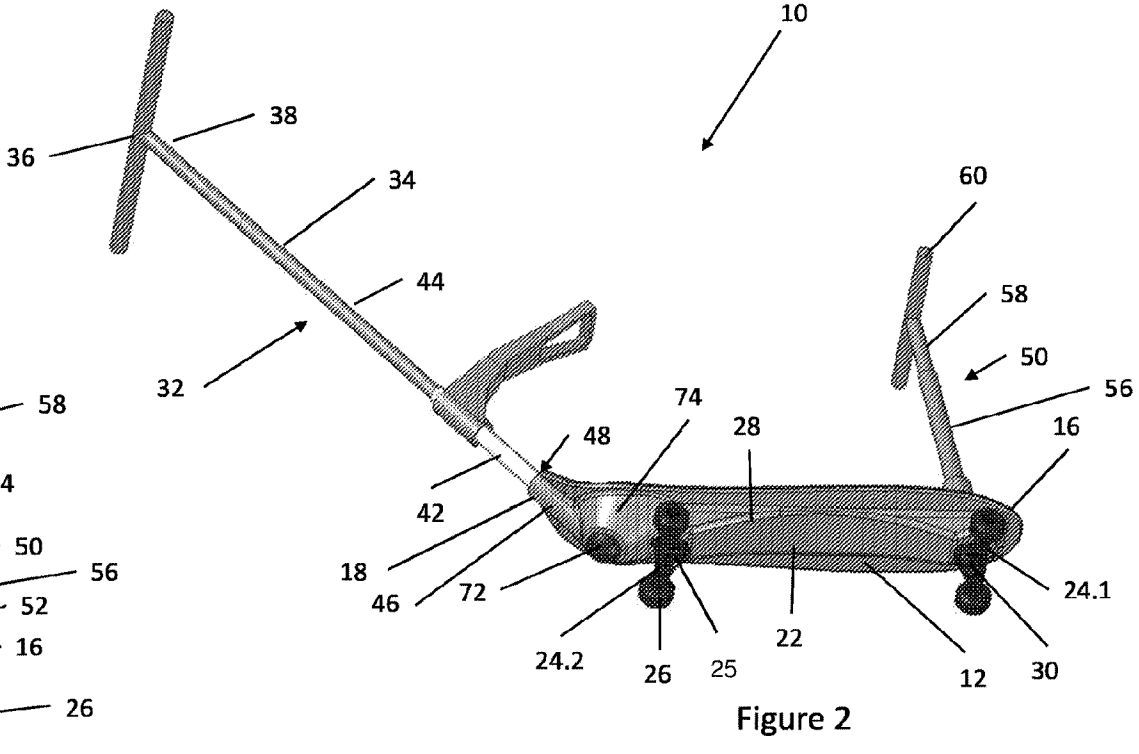
FIG. 2 shows a three-dimensional view, from below, of the personal transport apparatus of FIG. 1.
Figure 1:
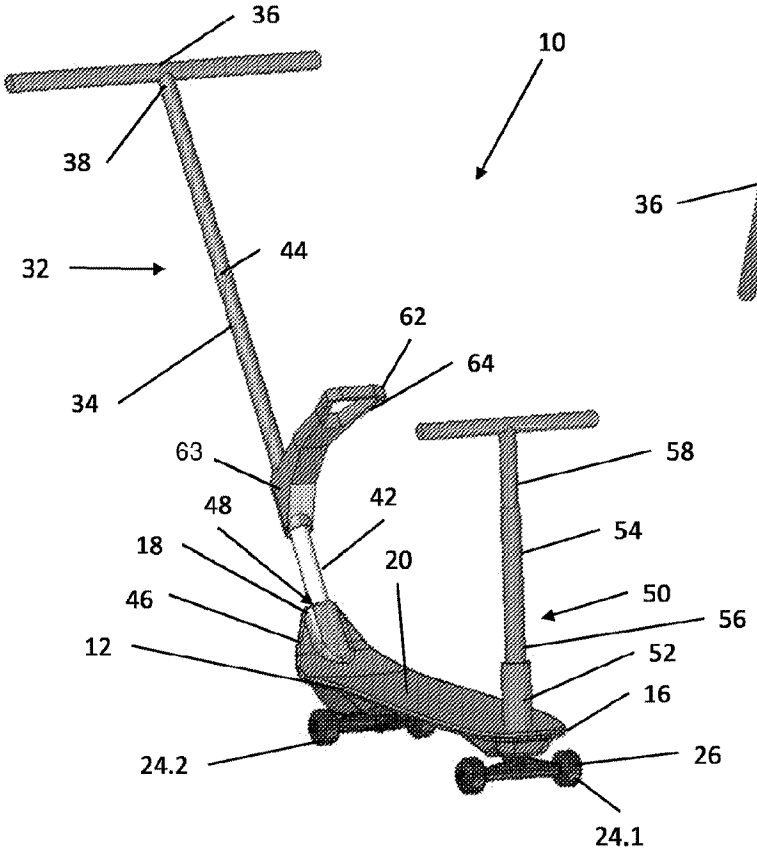
FIG. 1 shows a three-dimensional view, from above, of an embodiment of a personal transport apparatus.

In FIGS. 1 and 2, reference numeral 10 generally indicates an embodiment of a personal transport apparatus.

The apparatus 10 includes a deck 12. The deck 12 is configured for supporting a rider, for example, a child 14, in a standing position.

The deck 12 is elongate and has a front end 16 and a rear end 18. The deck 12 also has a top surface 20 and a bottom surface 22. The top surface 20 is configured so that the child 14 can stand on the deck 12.

Two wheel assemblies in the form of a front wheel assembly 24.1 and a rear wheel assembly 24.2 are mounted on the bottom surface 22 and positioned towards the front end 16 and the rear end 18 of the deck 12, respectively.

Each wheel assembly 24 includes a pair of wheels 26 so that the deck 12 can travel over a substrate.

Each wheel assembly 24 includes a truck 25, similar to that used for conventional skateboards. Thus, the bottom surface 22 defines a suitable mounting formation 28 for two kingpins 30 that are received in the mounting formation 28 to fasten the respective trucks 24 to the formation 28. It follows that the deck 12 can be tilted to steer the apparatus 10 in the same way as a skateboard is steered.

An operator handle 32 is substantially rigidly mounted on a rear end 18 the deck 12 and extends rearwardly from the deck 12 so that an operator 40 (FIG. 6) can grasp the operator handle 32 and push or pull the apparatus 10 along the substrate while the child 14 is supported on the deck 12. The operator handle 32 can extend upwardly and rearwardly with respect to the deck 12. The rigid mounting of the handle 32 also permits the operator 40 to tilt the deck 12 in any direction to simulate a riding experience for the child 14.

The operator handle 32 includes an elongate support 34 that is fixed to the deck 12 at the rear end 18 of the deck 12. It is to be understood that the elongate support 34 can also be fixed to the deck 12 at the front end 16 of the deck 12. The elongate support 34 is fixed to the deck 12 in a demountable manner.

The operator handle 32 includes a grip or handle bar 36 mounted on an upper end 38 of the support 34 so that the operator 40 can grasp the handle bar 36 while pushing or pulling the apparatus 10.

The support 34 includes a lower part 42 and an upper part 44 that are telescopically arranged with respect to each other. Thus, the lower part 42 is hollow and the upper part 44 can be received in the lower part 42. For example, both the parts 42, 44 can be cylindrical with the lower part 42 being tubular. Alternatively, the upper part 44 can be tubular with the lower part 42 being received in the upper part 44. Thus, a length of the support 34 can be adjusted to suit the operator 40. The support 34 can include a fastener to fasten the parts 42, 44 together at a selected length of the support 34. Alternatively, a spring-mounted button arrangement can be used to lock the parts positively to each other at a desired position.

A rear end portion 46 terminating at the rear end 18 of the deck 12 is angled upwardly and rearwardly and includes a mounting assembly having a socket member 47 (FIG. 7) that defines a socket 48 that opens at the rear end 18. The lower part 42 of the support 34 is received and fixed into the socket 48.

A rider handle 50 extends from the front end 16 of the deck 12. It will be appreciated that the positions of the rider handle 50 and the operator handle 32 are interchangeable.

The rider handle 50 includes a stub 52 that is arranged on the front end 16 and extends upwardly therefrom. The stub 52 is tubular. An elongate support 54 is received in the stub 52. Alternatively, the stub 52 could be received in the elongate support 54.

The elongate support 54 includes a lower part 56 and an upper part 58. The upper part 58 is received in the lower part 56 so that the elongate support 54 is telescopic for length adjustment. It is to be appreciated that the lower part 56 could be received in the upper part 58 with the same functionality. A handlebar 60 is mounted on the upper part 58 so that the child 14 can grasp the handlebar 60. The elongate support 54 can include a fastener so that the upper and lower parts 56, 58 can be fastened together with the handlebar 60 at a suitable height for the child 14.

Instead, or in addition, the apparatus 10 includes a rider handle 62 that is mounted on the operator handle at the support 34. For example, the rider handle 62 can be mounted on the lower part 42 of the support 34. To that end, the rider handle 62 includes a mounting body 63 having a passageway in which the lower part 42 can be secured. The rider handle 62 extends partially over the deck 12 and includes a grab handle 64 that can be held by the rider or child 14.

The parts 42, 44 and 56, 58 can be in the form of aluminium tubes or poles. The handle bars 36, 60 can also be of aluminium and can be covered with a suitable material, such as neoprene or rubber, for gripping comfort.

In FIGS. 3 to 8, reference numeral 70 generally indicates a further embodiment of a personal transport apparatus. With reference to the preceding drawings, like reference numerals refer to like parts, unless otherwise specified. The use of common reference numerals is for convenience only and is not intended to indicate that the components identified by the common reference numerals are essential for the apparatus 70. Furthermore, where practical, the components of the apparatus 10 and the apparatus 70 can be interchanged.

The personal transport apparatus 70 does not include the rider handle 50.

Figure 3:
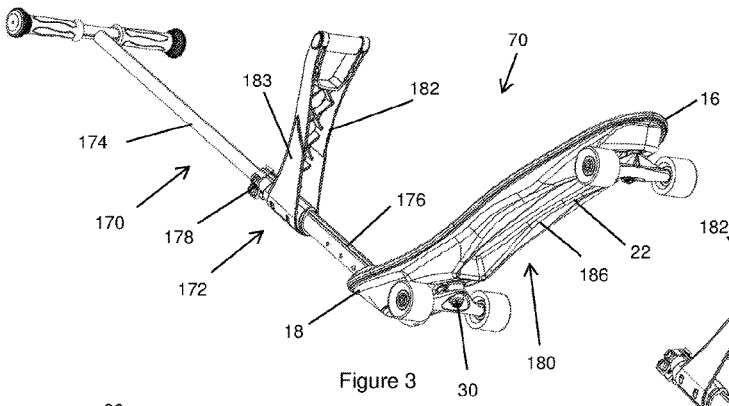
FIG. 3 shows a three-dimensional view, from below, of an embodiment of a personal transport apparatus with an operator handle.
Figure 5:
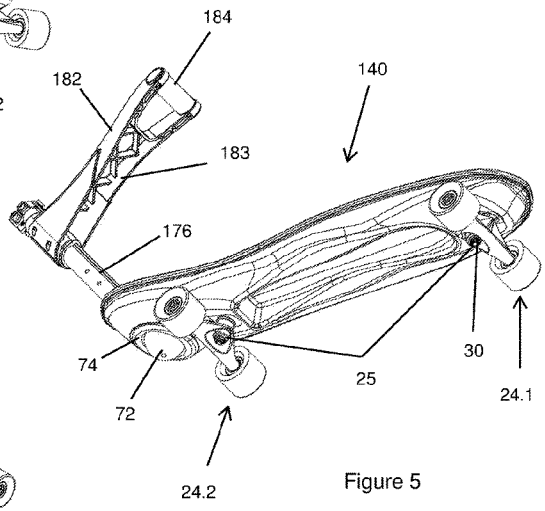
FIG. 5 shows the personal transport apparatus of FIG. 3, with part of the operator handle removed.
Figure 4:
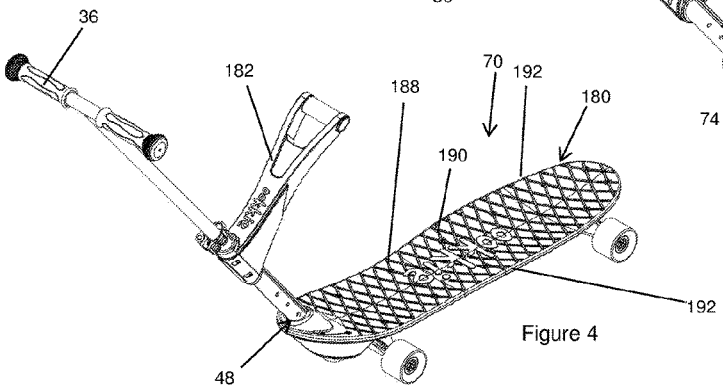
FIG. 4 shows the personal transport apparatus of FIG. 3, from above.

As can be seen in FIGS. 3 to 4, an operator handle 170 has an elongate support in the form of a post assembly 172. The post assembly 172 includes an upper part or tube 174 that is telescopically received in a lower part or tube 176. A fastening mechanism such as a clamping collar mechanism 178 is arranged on the lower tube 176 to clamp or fasten the tubes to each other with the post assembly 172 at a desired height.

The lower tube 176 can be attached, in a demountable manner to a deck assembly 180, as will be described in further detail with reference to FIG. 24.

The apparatus 70 includes a rider handle 182. The rider handle 182 includes a handle body 183 that defines a passage 187. The lower tube 176 extends through the passage 187 so that the handle body 194 can be fastened to the lower tube 176. The rider handle 182 is positioned on the lower tube 176 so that it can extend over the deck assembly 180. The rider handle 182 includes a grab handle 184 that can be gripped by the rider when standing on the deck assembly 180.

The deck assembly 180 includes a deck body 186. A deck cover 188 is mounted on the deck body 186. The deck cover 188 defines a standing surface for the rider. The deck cover 188 includes a pattern of ridges or projections 190 to enhance a grip of the rider.

The deck cover 188 has raised side edges 192. These can be defined by an arcuate or curved transverse cross-section so that side edges 192 of the deck cover 188 are raised. This facilitates tilting of the deck assembly 180 by the rider as a result of enhanced leverage as opposed to the case with a flat deck.

Figure 6:
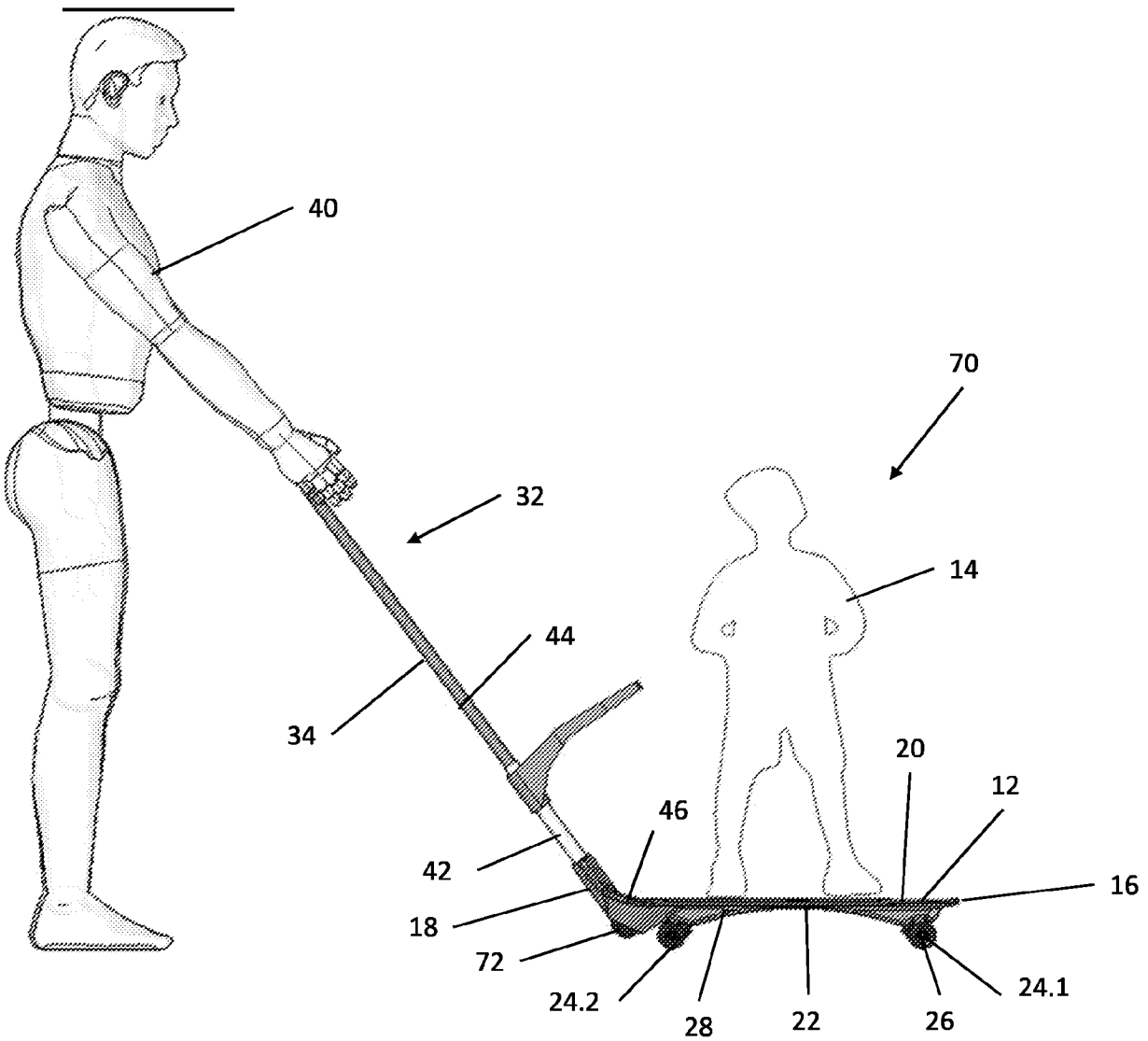
FIG. 6 shows a side view of the personal transport apparatus of FIG. 3, in use.
Figure 8:
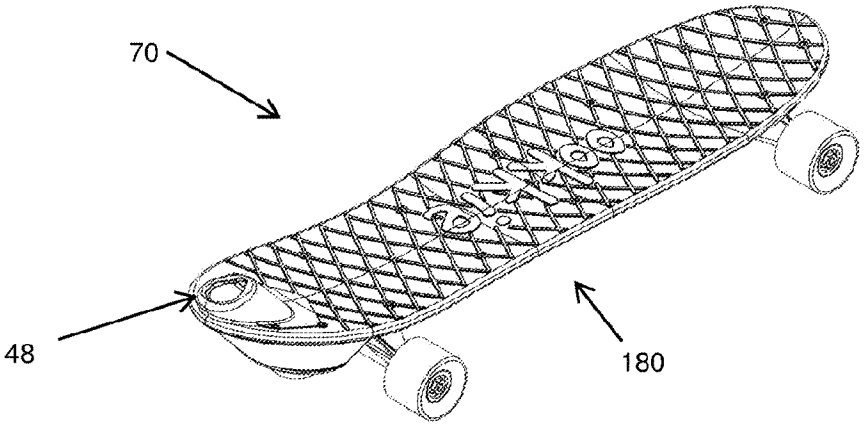
FIG. 8 shows a three-dimensional view, from above, of the personal transport apparatus of FIG. 3 with the operator handle removed.
Figure 7:
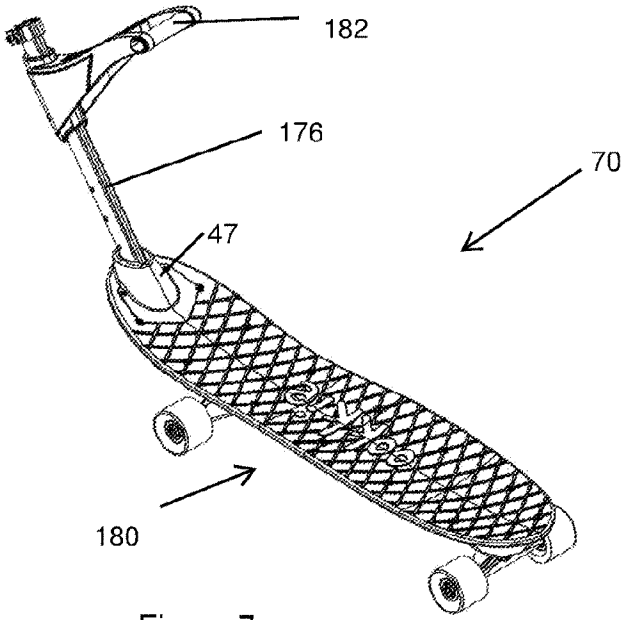
FIG. 7 shows a three-dimensional view, from above, of the personal transport apparatus of FIG. 3 with part of an operator handle removed.

FIG. 6 shows an initial stage of teaching a child how to skateboard using the apparatus 70. In the initial stage, the operator 40 can push the apparatus 70 along, with the child 14 standing on the deck assembly 180, using the operator handle 170. The child 14 can grasp the grab handle 184. In FIG. 7, the upper tube 174 of the handle 170 is removed and the child 14 can self-propel the apparatus 70, optionally using the grab handle 184 for balance. Once the child 14 has developed sufficient skill and confidence, the lower tube 176 can be removed, leaving a skateboard-like apparatus, as shown in FIG. 8.

Figure 9:
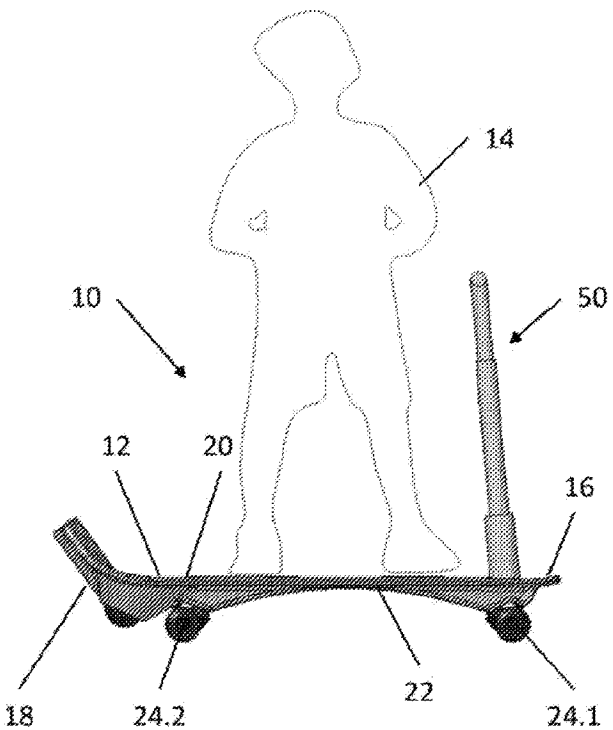
FIG. 9 shows a side view of the personal transport apparatus of FIG. 1 with an operator handle removed, in use.

In FIG. 9, there is shown the apparatus 10 with the operator handle 32 completely removed. In that configuration, the apparatus 10 can be used as a scooter.

The apparatus 10, 70 includes a ground-engaging formation in the form of an ellipsoidal or spheroidal projection 72 that extends from the bottom surface 22 of the deck 12 or deck assembly 180 between the rear end 18 and the rear wheel assembly 24.2. The projection 72 can be defined by a suitable spheroidal member mounted in a retaining formation 74 arranged on the bottom surface 22 of the deck 12.

The projection 72 can be formed of a wear-resistant material and selected so that the child 14 can push back on the rear end portion 46 to cause the deck 12 to tilt about an axis of a shaft of the truck 25 of the rear wheel assembly 24.2 such that the projection 72 is driven against the substrate while the front end of the deck 12 is lifted. This can help the child 14 to stop the apparatus 10, 70. Further, this can inhibit the front end 16 from rising too high and can also help in taking corners and performing tricks. The fact that the rear end portion 46 extends upwardly can facilitate the upward tilting manoeuvre described above.

The projection 72 can be of a hard-wearing plastics material. The deck 12, the mounting formation 28 and the retaining formation 74 can all be of a unitary, one-piece construction. For example, they can be of a single moulding of a plastics material.

Furthermore, when the handle 32 is used, the operator can tilt the deck 12 back to entertain or train the child 14. This is made possible as a result of the relatively rigid connection of the handle 170 to the deck assembly 180 in the manner described below with reference to FIGS. 21 to 24.

Figure 11:
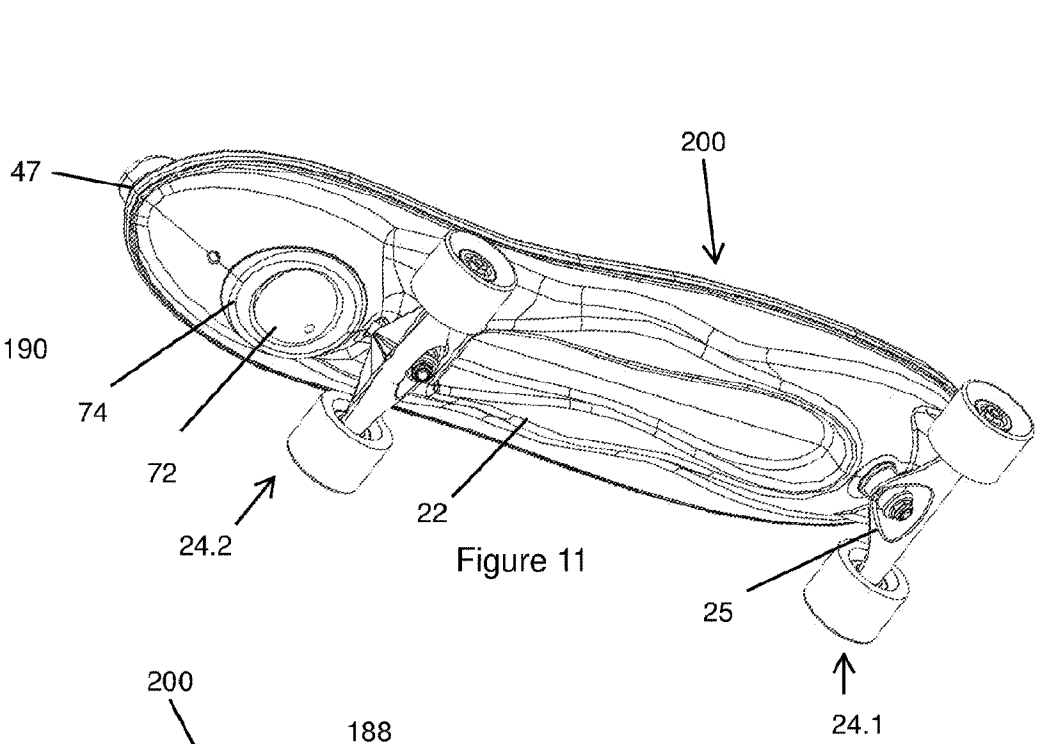
FIG. 11 shows a three-dimensional view, from below, of the personal transport apparatus of FIG. 10.
Figure 10:
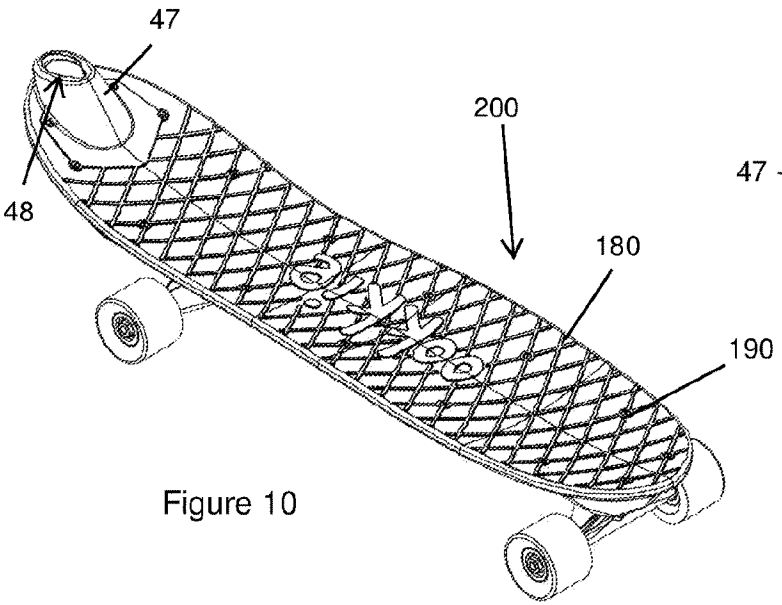
FIG. 10 shows a three-dimensional view, from above, of the personal transport apparatus of FIG. 3, without the operator handle.
Figure 12:
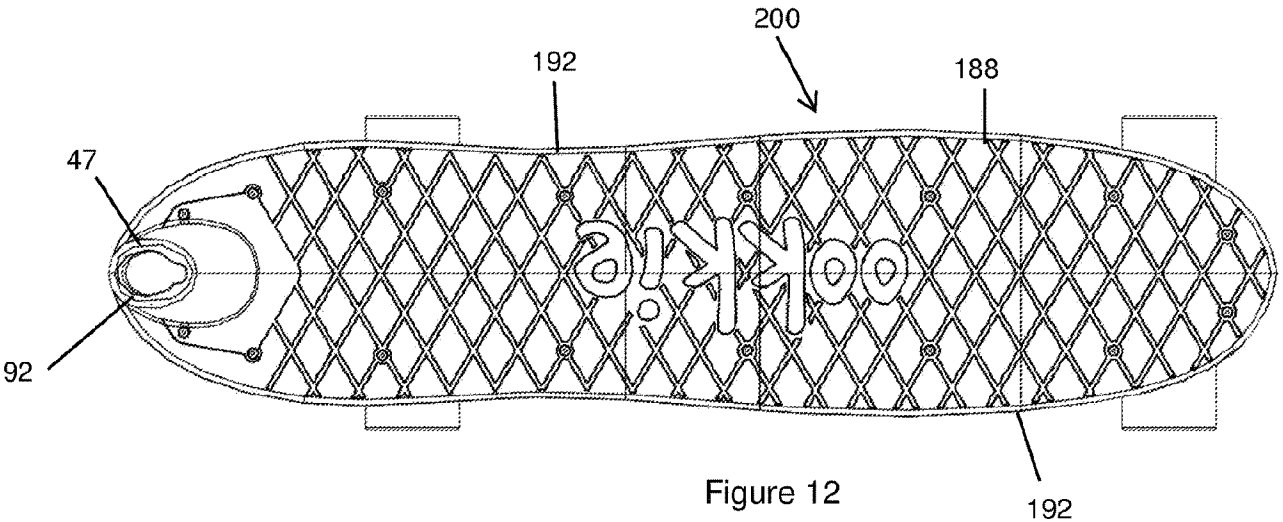
FIG. 12 shows a plan view of the personal transport apparatus of FIG. 10.
Figure 14:
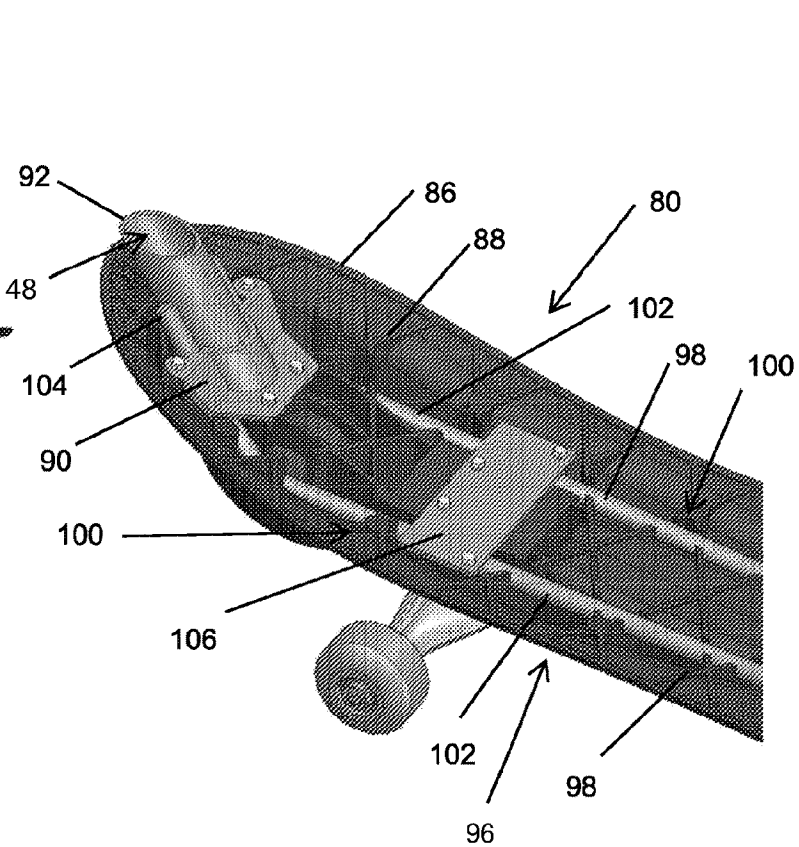
FIG. 14 shows a three-dimensional, internal view, from above, of the deck assembly of FIG. 13.
Figure 13:
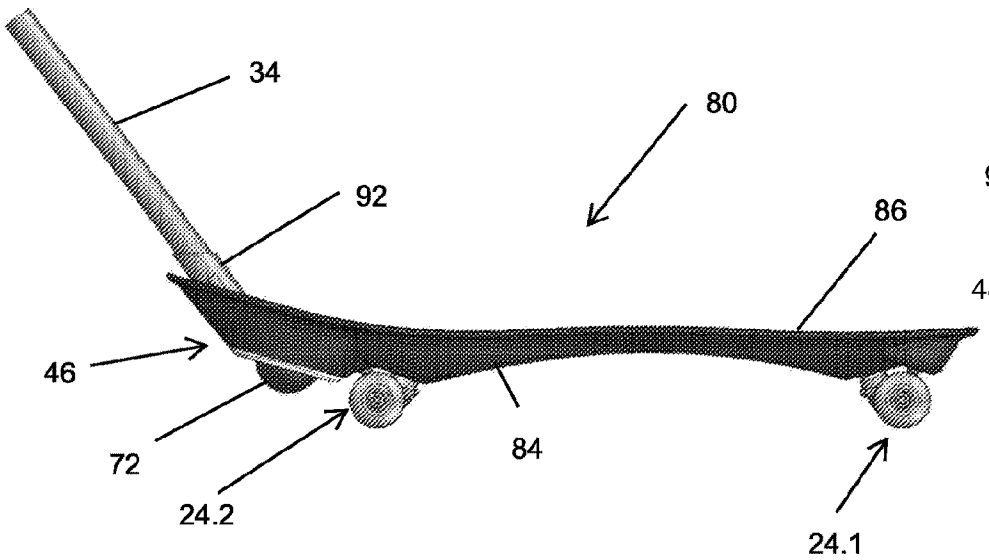
FIG. 13 shows a side view of an embodiment of a deck assembly for a personal transport apparatus.
Figure 16:
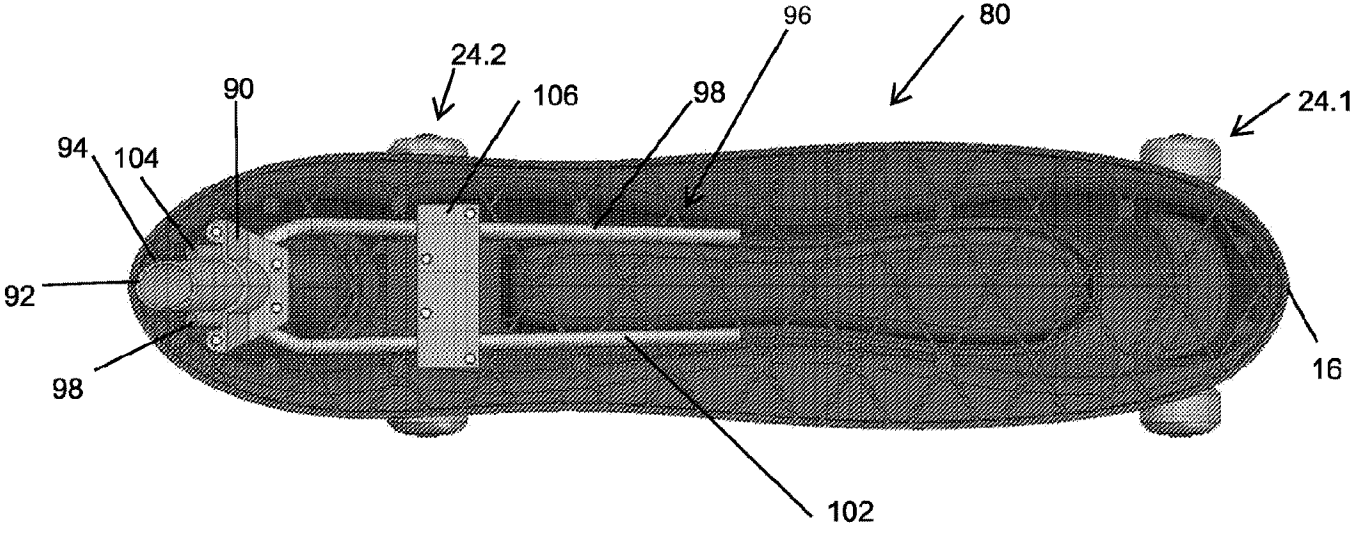
FIG. 16 shows a top plan view of an internal structure of the deck assembly of FIG. 13.
Figure 15:
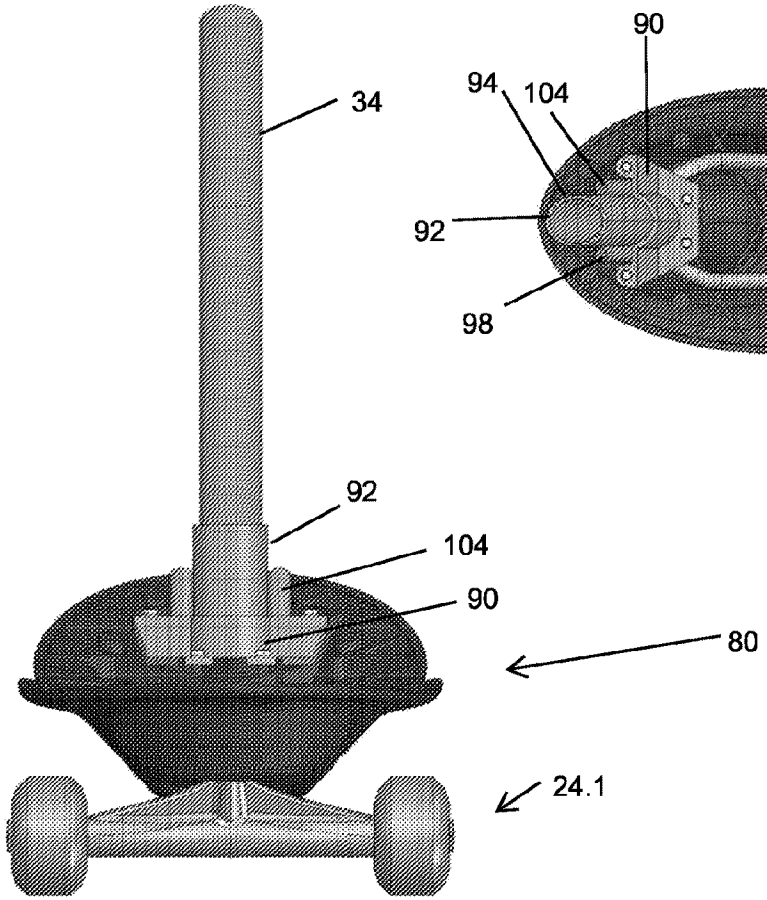
FIG. 15 shows a front view of the deck assembly of FIG. 13.

In FIGS. 10 to 12, reference numeral 200 generally indicates an embodiment of a personal transport apparatus. With reference to the preceding drawings, like reference numerals refer to like parts, unless otherwise specified. The use of common reference numerals is for convenience only and is not intended to indicate that any of the components with common reference numerals in the apparatus 200 and in the preceding drawings are necessarily the same.

The apparatus 200 is, effectively, the apparatus 70 with the operator handle removed. It is envisaged that the apparatus 200 can be supplied as shown in FIGS. 10 to 12 to be used as a conventional skateboard. Optionally, a rider can purchase the operator handle if the rider wishes to teach another rider how to skateboard, for example.

In FIGS. 13 to 16, reference numeral 80 generally indicates a deck assembly suitable for the apparatus. With reference to the preceding drawings, like reference numerals refer to like parts, unless otherwise specified. The use of common reference numerals is for convenience only and is not intended to indicate that any of the components with common reference numbers in the deck assembly 80 and in the preceding drawings are necessarily the same.

The deck assembly 80 includes a deck 82 and the front and rear wheel assemblies 24. A deck cover or panel 108 (FIG. 17) is removed to illustrate the internal structure of the deck 82.

The deck 82 includes a deck body 84. The deck body 84 is a moulding of a plastics material and defines a shell 86 and reinforcing formations 88 within the shell 86.

A chassis 96 is mounted in the deck body 84 to extend from the rear end portion 46 to about halfway along a length of the deck body 84. The chassis 96 could extend more or less depending on structural requirements.

The chassis 96 includes reinforcing members in the form of two spaced tilting members or tubes 98. Each tube 98 has a major section 102 that is dimensioned to extend along the deck body 84, to the extent described above. To that end, the reinforcing formations 88 define suitable recesses 100 in which the major sections are received. The recesses 100 are configured so that, when the tilting tubes 98 are positioned in the recesses 100, the tubes angle upwardly from the rear end portion 46 towards the front end 16.

Minor sections 104 of the tubes 98 extend upwardly and operatively with respect to the major sections 102.

A mounting arrangement or mounting assembly is arranged on the deck body 84. The mounting arrangement includes a mounting member in the form of a socket member 47 that defines the socket 48. The socket member can include a mounting tube 92 fastened to and interposed between the minor sections 104 so that the mounting tube 92 also extends upwardly and operatively with respect to the major sections 102.

A rear clamp 90 is bolted to the deck body 84 at the rear end portion 46. The clamp 90 is shaped to correspond with the mounting tube 92 and the minor sections 104 so that the clamp 90 can serve to clamp the minor sections 104 and the mounting tube 92 to the deck body 84.

An intermediate clamp 106 is clamped to the deck body 84 with the tilting tubes 98 interposed between the clamp 106 and the deck body 84.

Thus, the clamps 90, 106 serve to retain the chassis 96 in the deck body 84.

The mounting tube 92 is dimensioned to extend above the top surface 20 of the deck 82. The mounting tube 92 is open at an upper end 94 to define a socket. The elongate support 34 or the lower tube 176 can be received and mounted in the mounting tube 92 in a demountable manner. Thus, the plastics material of the deck body 84, 186 is protected from stresses resulting from operation of the handle 32, 170. These stresses can be significant depending on the weight of the child and the way the operator handle is operated.

The tilting tubes 98 are of sufficient rigidity and strength to reinforce the deck body 84 and the deck cover 86. The tilting tubes 98 are positioned to provide support to the deck cover 86 so that sagging of the deck cover 86 is inhibited.

The tilting tubes 98 are also of a sufficient rigidity and strength and are positioned so that when the handle 32 is tilted to either side, or backwards and forwards, to tilt the deck assembly 80, stress generated by the resultant torque is dissipated along the length of the major sections 102 to protect the plastic material of the deck body 84 and the deck cover 86. It will be appreciated that, without the chassis 96, stress will be concentrated at the point of connection of the support 34 and deck assembly 80. This can be undesirable since it can result in damage to the deck assembly 80.

It is envisaged that the deck assembly could incorporate or define the socket 48 in a structure that is of sufficient strength to itself perform the role of the chassis 96.

The mounting tube 92 and the tilting tubes 98 are of metal, such as aluminium or steel, in one embodiment. The minor sections 104 can be welded to the mounting tube 92.

As the operator handle is tilted, the torque is transmitted to the rear clamp 90. The rear clamp 90, in turn, bears against the minor sections 104 so that the torque is transmitted into the tilting tubes 98. It will be appreciated that this inhibits the transmission of stresses resulting from the application of that torque to the material of the deck body.

Figure 18:
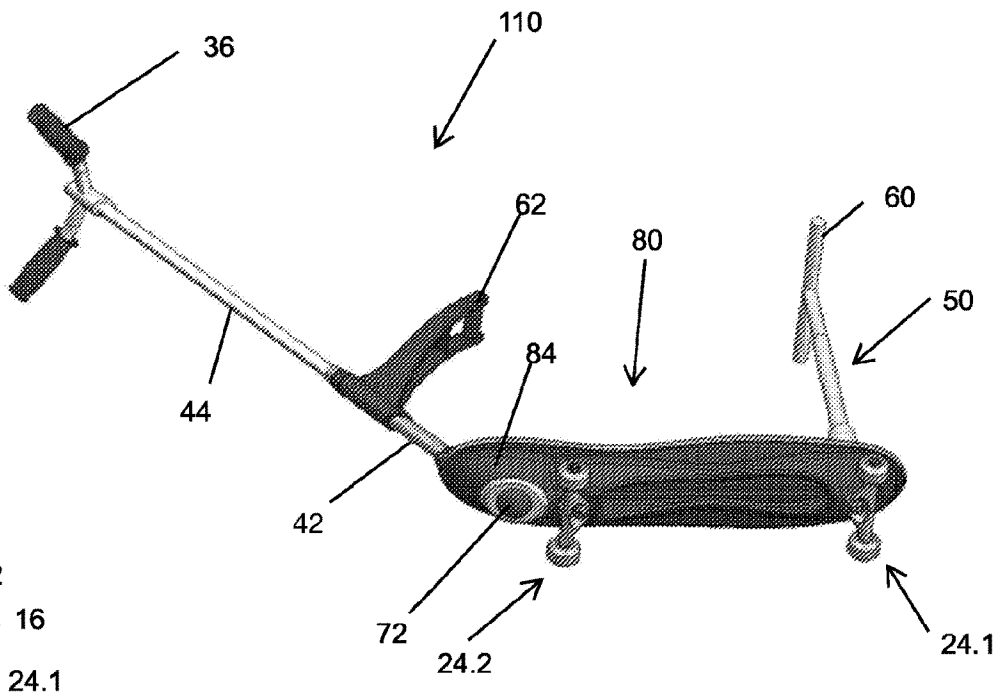
FIG. 18 shows a three-dimensional view, from below, of the personal transport apparatus of FIG. 17.
Figure 17:
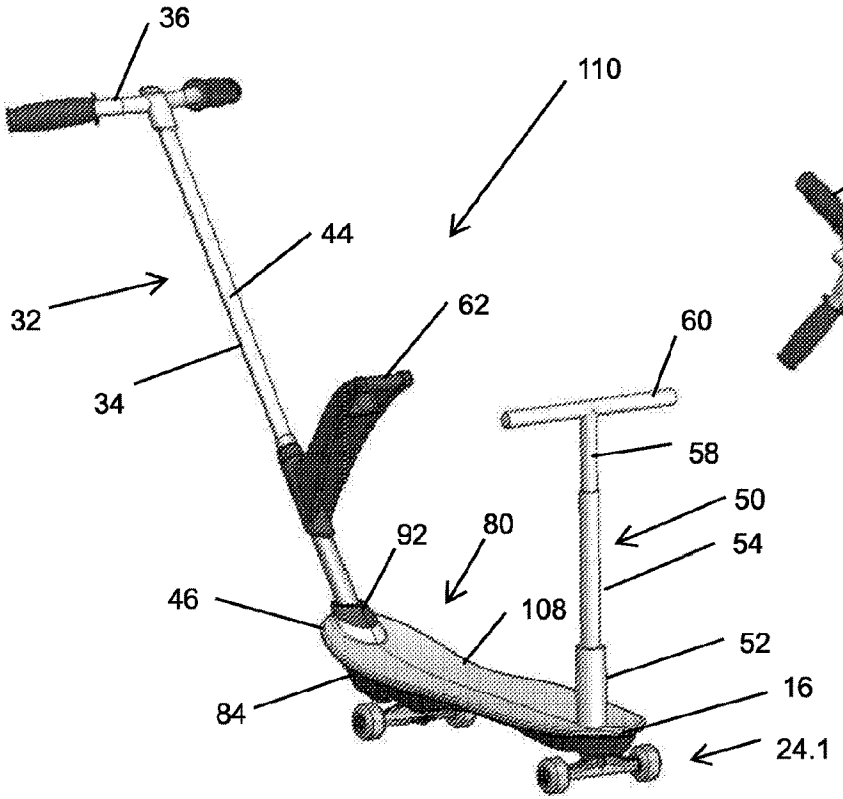
FIG. 17 shows a three-dimensional view, from the front, of an embodiment of a personal transport apparatus.

In FIGS. 17 and 18, reference numeral 110 generally indicates a further exemplary embodiment of a personal transport apparatus. With reference to the preceding drawings, like reference numerals refer to like parts, unless otherwise specified. The use of common reference numerals is for convenience only and is not intended to indicate that any of the components with common reference numbers in the deck assembly 80 and in the preceding drawings are necessarily the same.

The apparatus 110 includes the deck assembly 80.

Figure 20:
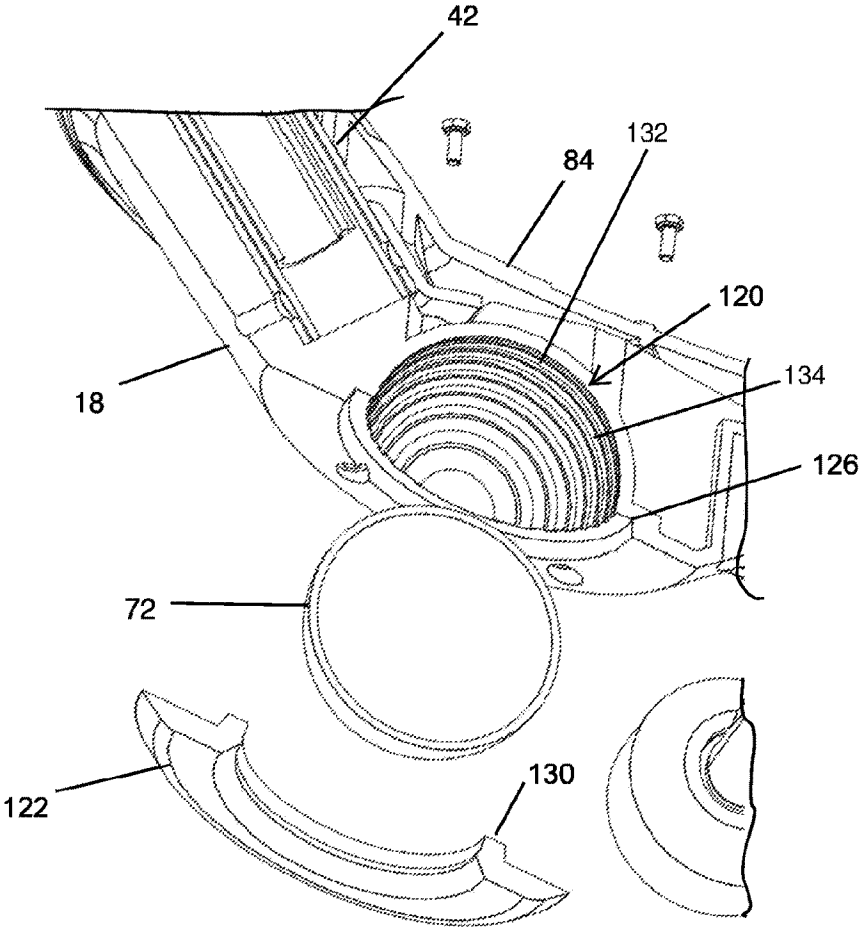
FIG. 20 shows a sectioned, three-dimensional, exploded view of the part shown in FIG. 13.
Figure 19:
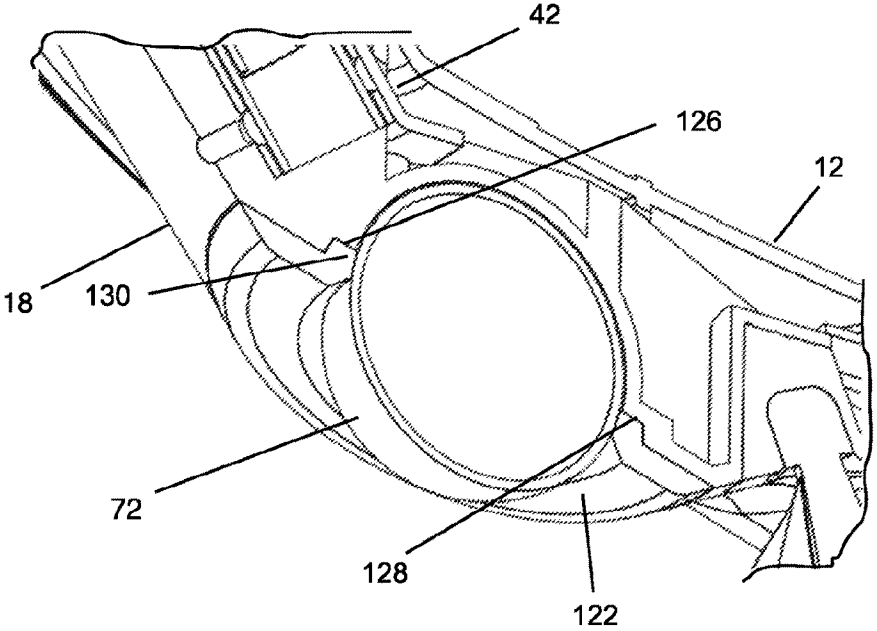
FIG. 19 shows a sectioned, three-dimensional view of part of the deck assembly, illustrating the mounting of a ground-engaging formation.

In FIGS. 19 and 20, there is shown further detail of the ground-engaging formation that is defined by a ball 72. The deck body 84 defines a spheroidal recess 120. The recess 120 can be formed in the moulding of the body 84. The recess 120 is dimensioned to correspond generally with the ball 72 so that the ball 72 can be received in the recess 120 and retained therein to have full rotational freedom about any axis relative to the deck body 84. The ball 72 is hollow and is moulded of a wear-resistant plastics material.

An annular retainer 122 is fastenable to the body 84 to retain the ball 72 partially in the recess 120, with part of the ball 72 protruding through the retainer 122 to engage the ground. A periphery 126 of the recess 120 defines a shoulder 128. The retainer 122 defines a rim 130 that corresponds with the shoulder 128 and presents a surface that is continuous with an internal surface of the recess 120. A depth of the recess 120, measured from the shoulder 128, is less than a radius of the recess 120. A depth of the recess 120 measured from an upper edge of the rim 130 is greater than a radius of the recess 120. Thus, with the retainer 122 removed, the ball 72 can fit in the recess 120. With the retainer 122 fastened to the body 84, the rim 130 serves to retain the ball 72 within the recess 120.

When the user tilts the deck 12 or deck assembly 180 about the rear truck assembly 24.2, the apparatus 10, 70 can continue to travel forward without flipping, as would be the case with a conventional skateboard. This can provide a sense of security for the user. This is also the case for the child 14 and the operator 40 when the operator 40 tilts the deck in a generally vertical plane.

Also, in some cases, the user can tilt the deck 12 or deck assembly 180 so that the entire weight of the user is carried by the ball 72 with both truck assemblies 24 lifted off the ground. In that condition, the user can perform turns and other tricks easier than if one of the truck assemblies 24 was still on the ground.

An inner surface 132 of the recess 120 defines a series of ridges, edges or protrusions 134. These serve to minimize friction between the ball 72 and the inner surface 132 by reducing a contact area between the ball 72 and the inner surface 132.

Figure 21:
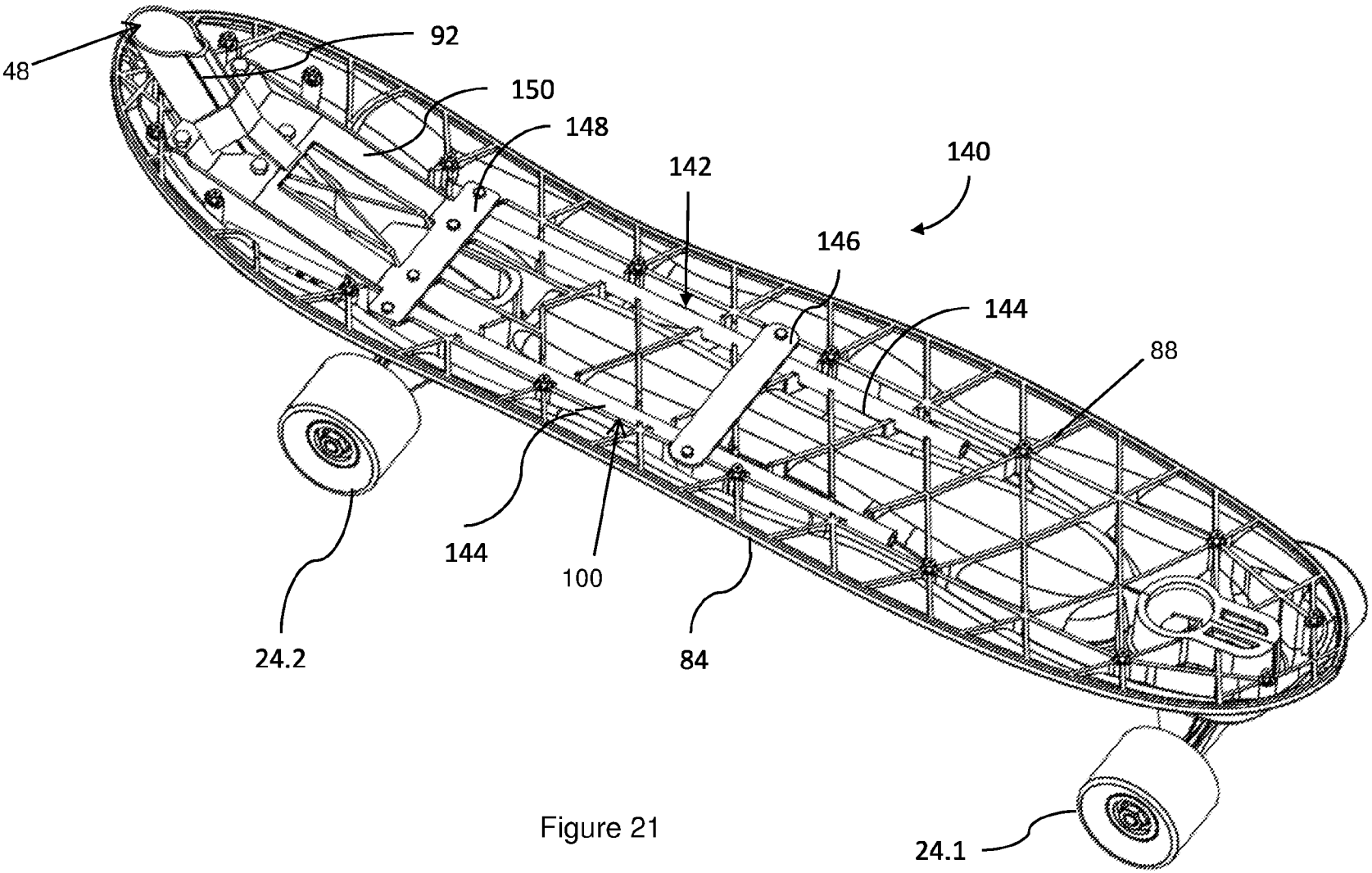
FIG. 21 shows a three-dimensional view of a deck assembly for the personal transport apparatus with a deck cover removed to show a chassis of the personal transport apparatus.
Figure 22:
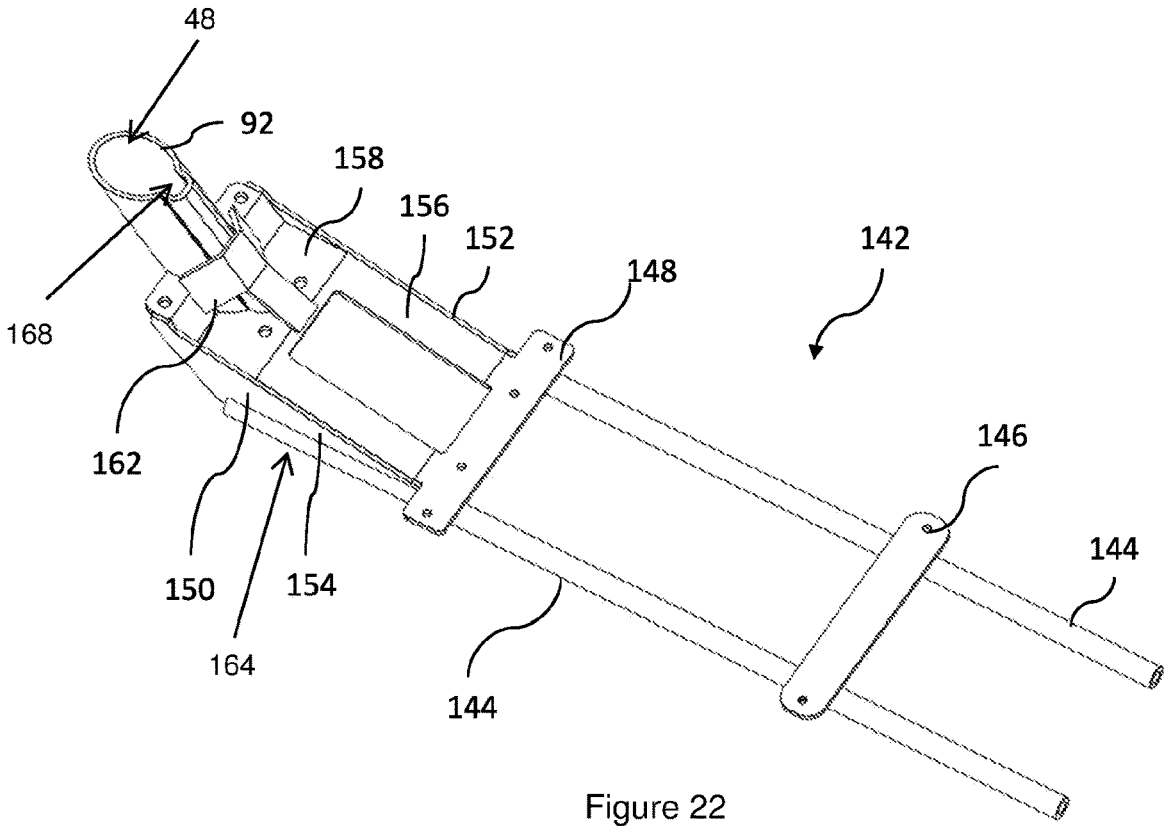
FIG. 22 shows a three-dimensional view, from above, of a chassis of the deck assembly of FIG. 20.
Figure 23:
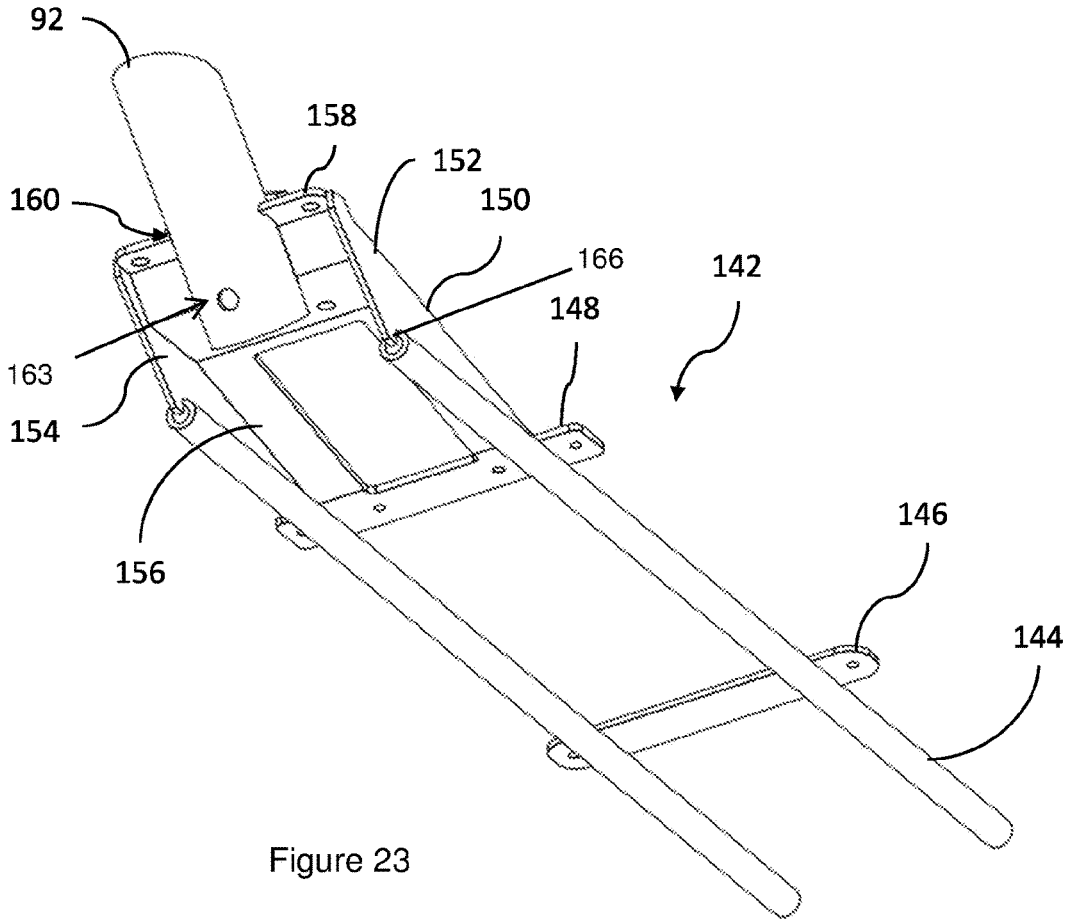
FIG. 23 shows a three-dimensional view, from below, of the chassis of FIG. 22
Figure 24:
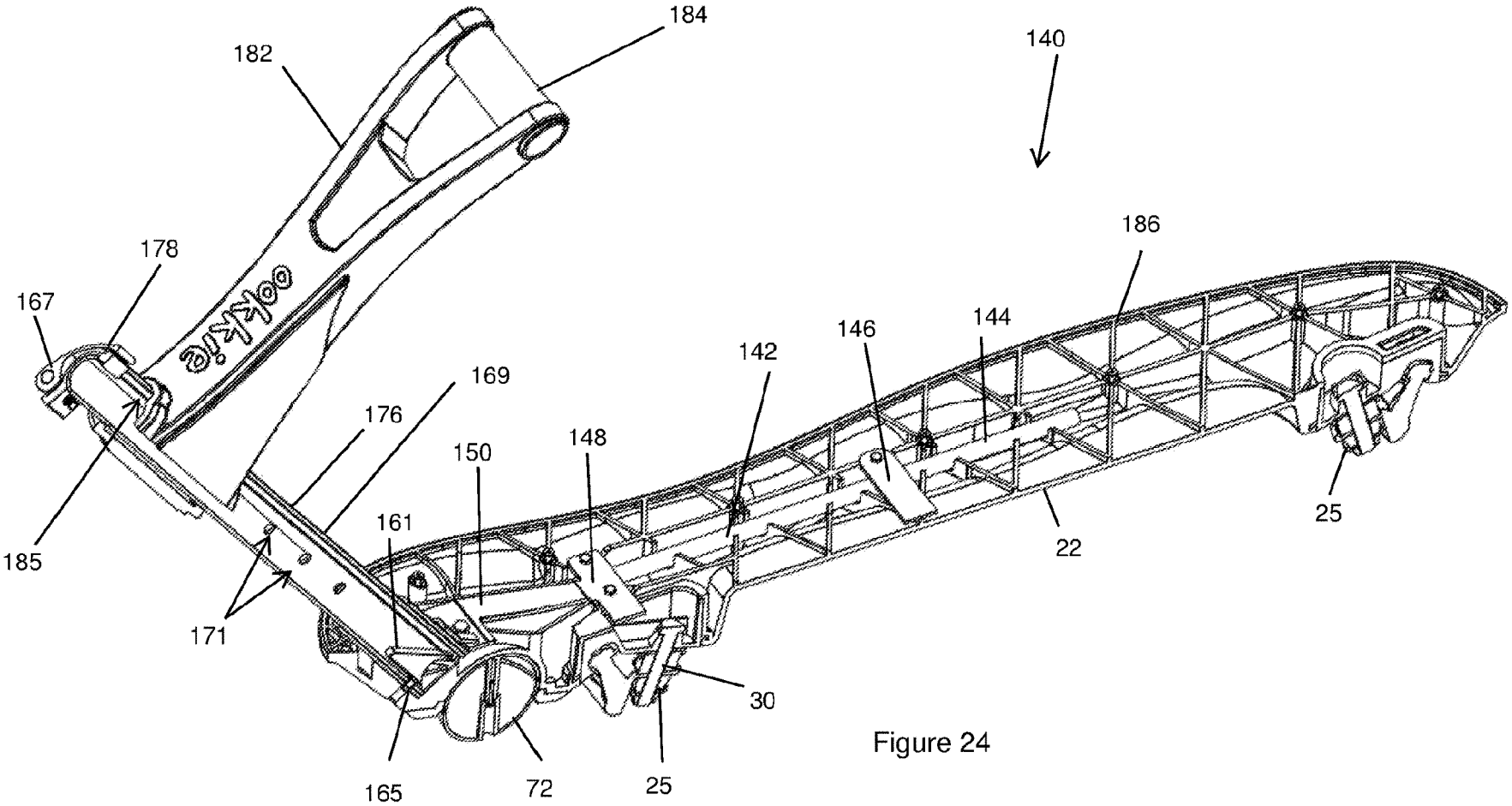
FIG. 24 shows a sectioned, three-dimensional view of the deck assembly of FIG. 21, with part of an operator handle mounted to the chassis.

In FIGS. 21 and 24, there is shown an example of a suitable deck assembly 140 for the apparatus described herein. With reference to the preceding drawings, like reference numerals refer to like parts, unless otherwise specified. The use of common reference numerals is for convenience only and is not intended to indicate that the components identified by the common reference numerals are essential. Furthermore, where practical, the components of the deck assembly 140 can be interchanged with components of the other deck assemblies described herein.

The deck assembly 140 includes a substructure or chassis 142. The chassis 142 is similar to the chassis 96, as will be apparent from the common numbers.

The chassis 142 includes one or more reinforcing members. The reinforcing members are in the form of two elongate tilt members in the form of tilting tubes 144. The tilting tubes 144 are positioned in respective recesses 100 and extend from a position behind the rear wheel assembly 24.2 to a position interposed between the rear and front wheel assemblies 24.2, 24.1.

A front bracing member 146 is secured to the deck body 84 with the tilting tubes 144 interposed between the front bracing member 146 and the deck body 84. The front bracing member 146 is secured to the deck body between the rear and front wheel assemblies 24.2, 24.1.

A rear bracing member 148 is secured to the deck body 84 with the tilting tubes 144 interposed between the front bracing member 146 and the deck body 84. The rear bracing member 148 can be at or near or behind the rear wheel assembly 24.2.

The rear bracing member 148 forms part of a bracket 150 of a mounting assembly to which the mounting tube 92 is attached. The bracket 150 includes a carrier 152. The carrier 152 has two sidewalls 154 that are connected to, or fixed to, respective tubes 144. The sidewalls 154 are triangular, with an apex at the rear bracing member 148 and an operatively lower edge connected to one of the tubes 144. The carrier 152 includes a front wall 156 that interconnects operatively upper edges of the sidewalls 154. The front wall 156 therefore slopes upwardly from the rear bracing member 148. A mounting structure 158 is arranged between the sidewalls 154 and behind the front wall 156. The mounting tube 92 is arranged on the mounting structure 158.

The mounting tube 92 defines a longitudinal keying recess 168 to receive a longitudinally extending key formation 169 on the lower tube 176 (FIG. 24) when the lower tube 176 is received in the mounting tube 92 that defines a socket for the lower tube 176. This serves to inhibit twisting of the operator handle 170 relative to the chassis 142 when, for example, the operator changes direction when cornering.

The front wall 156 and the mounting structure 158 can be one-piece. The front wall 156 and the mounting structure 158 can be welded or otherwise fastened between the sidewalls 154.

The mounting structure 158 defines a recess 160 to accommodate the mounting tube 92. The mounting tube 92 can be welded into the recess 160. The mounting tube 92 can be fastened in the recess 160 in other ways.

A reinforcing bracket 162 can be fastened to the mounting structure 158 so that the tube 92 is interposed between the mounting structure 158 and the bracket 162.

Each sidewall 154 defines a recess 164 in a lower edge in which a rear section of one of the tubes 144 can be received. Each sidewall 154 thus defines a lug 166 that engages a rear end of each respective tube 144. Thus, when the elongate support 34 is tilted back, the lugs 166 can be driven against the tubes 144, so bearing a portion of the weight of the deck assembly and child directly, to limit torsional strain on the tubes 144. This also serves to limit or ameliorate upward forces on the deck body resulting from the tubes 144 being driven against the bracing members 146, 148.

The rear sections of the tubes 144 can be welded into the recesses 164 or attached to the sidewalls 154 by some other means, such as industrial adhesive.

The chassis 142 can be of steel or aluminium.

The configuration of the chassis 142 provides a structure that can support a user or child while the deck assembly 140 is tilted in any direction. As set out above, a large amount of torque can be generated at the mounting tube 92 when the operator 40 uses the handle 32 to tilt the deck assembly 140 to raise or lower the child. The chassis 142 is designed to bear the stresses and to prevent those stresses from being applied to the material of the deck body 84. The chassis 142 also serves to inhibit sagging or bending of the deck assembly 140 because of the weight of the rider.

The chassis 142 can be of steel or aluminium. The chassis 142 can be assembled by welding.

FIG. 24 shows a side sectioned, three-dimensional view of the deck assembly 140 with the lower tube 176 mounted on the chassis 140. The rider handle 182 is mounted on the lower tube 176.

As can be seen, the clamping collar mechanism incorporates an over-center locking mechanism 167.

A lug or button 165 in mounted in the lower tube 176 to be displace able into and out of a hole defined in the lower tube 176. The hole in the tube 176 is in register with a hole 163 in the mounting tube 92 when the lower tube 176 is mounted in the tube 92. The button 165 is mounted in the lower tube 176 via a spring 161 so that it can be biased into an operative position in which it extends through both holes to lock the tubes 92, 176 together. The button 165 can be depressed, against the bias of the spring 161 to release the tubes from each other for dementing the handle 170.

The handle body 183 defines a longitudinal channel 185 opening into the passage 187. The key 169 is received in the channel 185 to inhibit twisting of the handle 182 relative to the handle 170.

The tube 176 defines a series of openings 171 so that a similar push button mechanism can be used to adjust a height of the handle 170.

The apparatus described herein can be used for helping people, for example children, to learn how to skateboard. The apparatus can be used for transitions learners from a riding position in which they are able to hold on to a handle to maintain balance while the apparatus is under the control of an operator, to a position in which the learners can control the apparatus while holding a handle, and ultimately to a position in which the learners can control the apparatus without the handle, for example, effectively skateboarding unassisted.

The inventor(s) submits that the apparatus described herein allows a carder to teach a child how to skateboard. The apparatus provides a means whereby the child can become familiar with the motion of skateboarding while having handles to provide stability. Eventually, the handles can be removed so that the child can use the apparatus as a conventional skateboard.

The inventor(s) envisages that the apparatus can be used generally to teach children and other riders how to balance. For example, the apparatus need not be limited in its application to children. It is conceivable that adults could use the apparatus to improve balance and technique for sports such as skateboarding, surfing, skiing and other activities that require balance.

The word "skateboard" is used in a relatively broad, generic sense. It is intended to cover any personal transport apparatus having a deck to support a person and one or more wheel assemblies mounted on the deck so that the deck can travel over a substrate. As a verb, the word is used to describe the action of using such a personal transport apparatus.

It is also to be understood that the word "personal" is to refer to an article that would be regarded as personal in the sense that it is usually used by one person.

The appended claims are to be considered as incorporated into the above description.

Throughout the specification, including the claims, where the context permits, the term "comprising" and variants thereof such as "comprise" or "comprises" are to be interpreted as including the stated integer or integers without necessarily excluding any other integers.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Words indicating direction or orientation, such as "front", "rear", "back", etc, are used for convenience. The inventor(s) envisages that various embodiments can be used in a non-operative configuration, such as when presented for sale. Thus, such words are to be regarded as illustrative in nature, and not as restrictive.

It is to be understood that the terminology employed above is for description and should not be regarded as limiting. The described embodiments are intended to be illustrative of the invention, without limiting the scope thereof. The invention is capable of being practised with various modifications and additions as will readily occur to those skilled in the art.

The invention claimed is:

1. A personal transport apparatus which comprises:

an elongate deck configured for supporting a rider in a standing position;

a rear wheel assembly mounted on a bottom surface of the deck and positioned towards a rear end of the deck;

a front wheel assembly mounted on the bottom surface of the deck and positioned towards a front end of the deck, the wheel assemblies each having at least one wheel so that the deck can travel over a substrate;

an operator handle substantially rigidly mounted on a rear end of the deck and extending rearwardly from the deck so that an operator, standing on the substrate, can grasp the operator handle and push the apparatus along the substrate, or tilt the apparatus relative to the substrate, while the rider is supported on the deck, the operator handle including an elongate support that is mountable to the deck at one end of the deck; and a rider handle mounted on the elongate support and extending forwardly from the elongate support, the rider handle being positioned so that the rider can grasp the rider handle for balance while supported by the deck.

2. The personal transport apparatus as claimed in claim 1, in which each wheel assembly includes a pair of the wheels.

3. The personal transport apparatus as claimed in claim 2, in which each wheel assembly includes a truck that is fastened to a bottom surface of the deck with each pair of wheels being mounted on respective trucks.

4. The personal transport apparatus as claimed in claim 1, in which the elongate support is demountable.

5. The personal transport apparatus as claimed in claim 4, in which the deck includes a socket member that defines a socket, one end of the support being receivable in the socket.

6. The personal transport apparatus as claimed in claim 1, in which the deck includes a deck body, a chassis mounted in the body to extend from a rear end portion of the body to a position beyond the rear wheel assembly and a deck cover arranged on the body.

7. The personal transport apparatus as claimed in claim 6, in which the chassis includes a bracket at its rear end, a mounting member for the operator handle being fastened to the bracket so that the mounting member extends upwardly and rearwardly from the chassis, the mounting member also extending through the deck cover.

8. The personal transport apparatus as claimed in claim 7, in which the mounting member is in the form of a mounting tube that defines a socket and wherein one end of the elongate support is received in the socket.

9. The personal transport apparatus as claimed in claim 8, in which the chassis includes at least one reinforcing member that extends at least partly along a length of the body.

10. The personal transport apparatus as claimed in claim 9, in which the, or each, reinforcing member is in the form of two elongate tilt members that are operatively engaged with the bracket and fastened to the deck body, the tilt members being spaced apart and extending from the bracket to at least a position interposed between the rear and front wheel assemblies so that torque applied to the bracket can be transferred to the tilt members and thus the deck body.

11. The personal transport apparatus as claimed in claim 10, in which the tilt members are fastened to the deck body with at least one bracing member.

12. The personal transport apparatus as claimed in claim 1, in which the operator handle includes a handle bar mounted on an upper end of the elongate support so that the operator can grasp the handle bar while pushing or pulling the transport apparatus.

13. The personal transport apparatus as claimed in claim 1, in which a ground-engaging formation is arranged on the bottom surface of the deck and is interposed between the rear wheel assembly and the rear end of the deck.

14. The personal transport apparatus as claimed in claim 13, in which the ground-engaging formation is in the form of one of an ellipsoidal projection and a spheroidal projection.

15. The personal transport apparatus as claimed in claim 14, in which the ground-engaging formation is in the form of a ball that is rotatable relative to the deck.

16. The personal transport apparatus as claimed in claim 15, in which the ball has full rotational freedom relative to the deck.

17. A personal transport apparatus which comprises:

an elongate deck configured for supporting a rider in a standing position;

a rear wheel assembly mounted on a bottom surface of the deck and positioned towards a rear end of the deck;

a front wheel assembly mounted on the bottom surface of the deck and positioned towards a front end of the deck, the wheel assemblies each having at least one wheel so that the deck can travel over a substrate;

an operator handle mounting assembly arranged at a rear end of the deck and configured to permit the operator handle to be substantially rigidly mounted on the rear end of the deck and extending rearwardly from the deck so that an operator, standing on the substrate, can grasp the operator handle and push the apparatus along the substrate, or tilt the apparatus relative to the substrate, while the rider is supported on the deck, the operator handle including an elongate support that is mountable to the deck at one end of the deck; and a rider handle mounting assembly arranged on the elongate support to permit a rider handle to be mounted on the elongate support to extend forwardly from the elongate support and to be positioned so that the rider can grasp the rider handle for balance while supported by the deck.

* * * * *